US012128268B1

(12) United States Patent
Biele

(10) Patent No.: US 12,128,268 B1
(45) Date of Patent: Oct. 29, 2024

(54) STRETCHING APPARATUS AND METHOD OF STRETCHING

(71) Applicant: Teo Biele, Santa Fe, NM (US)

(72) Inventor: Teo Biele, Santa Fe, NM (US)

( * ) Notice: Subject to any disclaimer, the term of this patent is extended or adjusted under 35 U.S.C. 154(b) by 390 days.

(21) Appl. No.: 17/688,393

(22) Filed: Mar. 7, 2022

Related U.S. Application Data

(63) Continuation-in-part of application No. 16/720,408, filed on Dec. 19, 2019, now abandoned.

(60) Provisional application No. 62/781,967, filed on Dec. 19, 2018.

(51) Int. Cl.
*A63B 21/00* (2006.01)
*A63B 23/00* (2006.01)

(52) U.S. Cl.
CPC .. *A63B 21/00185* (2013.01); *A63B 21/00043* (2013.01); *A63B 21/4007* (2015.10); *A63B 21/4015* (2015.10); *A63B 2023/006* (2013.01); *A63B 2208/0223* (2013.01); *A63B 2208/0238* (2013.01)

(58) Field of Classification Search
CPC ..... A63B 21/00185; A63B 21/4007; A63B 21/4009; A63B 21/4011–4015; A63B 21/00043; A63B 2023/006; A63B 2208/0223; A63B 2208/0238; A61H 1/0218; A61H 1/0237–0266
See application file for complete search history.

(56) References Cited

U.S. PATENT DOCUMENTS 3,411,500 A * 11/1968 James ..... A63B 21/4009 600/20
5,588,941 A * 12/1996 Scott ..... A61H 1/0218 482/131
5,643,184 A * 7/1997 Toso ..... A61F 5/026 450/155
5,716,307 A * 2/1998 Vadher ..... A63B 21/4043 482/125
5,813,955 A * 9/1998 Gutkowski ..... A63B 21/4007 482/121
9,216,311 B2 * 12/2015 Champion ..... A63B 23/03575
10,667,941 B1 * 6/2020 Breibart ..... A63B 21/4007
10,688,334 B2 * 6/2020 Huang ..... A61H 1/0266
2007/0135278 A1 * 6/2007 Grigoriev ..... A63B 21/0004 482/124

(Continued)

FOREIGN PATENT DOCUMENTS

AT 511696 A4 * 2/2013 ..... A63B 21/0428
DE 102019125456 A1 * 3/2021

*Primary Examiner* — Gary D Urbiel Goldner
(74) *Attorney, Agent, or Firm* — Rod D. Baker

(57) ABSTRACT

A hands-free human exercise apparatus and method, including a method of use. The stretching apparatus and method promote beneficial stretching of ambulatory muscles for a broad spectrum of users, to maintain and increase flexibility and dexterity, improved joint health, mobility, or pain management, and facilitating greater balance and proprioception and stimulating rehabilitation. The apparatus includes a multi-directional, multi-configurable, and adjustable harness comprising a one or dual strap configuration having a unique multi-joint activating foot anchor. The apparatus and method facilitate stretching of a single leg, or both legs, through the ambulatory chain of muscles and joints, and with the foot anchor exploiting the flexion of the spine, full extension of the leg and pelvis, and the full flexion of the user's foot.

14 Claims, 7 Drawing Sheets

(56) References Cited

U.S. PATENT DOCUMENTS

2014/0342884 A1* 11/2014 Aldridge ..... A61H 1/0274
482/131
2019/0380904 A1* 12/2019 Panizzolo ..... A63B 21/4009

* cited by examiner

STRETCHING APPARATUS AND METHOD OF STRETCHING

CROSS-REFERENCE TO RELATED APPLICATIONS

This application is a continuation-in-part of, and claims priority to, U.S. patent application Ser. No. 16/720,408 titled "Stretching Apparatus and Method of Stretching" filed 19 Dec. 2019, which claimed the benefit of the filing of U.S. Provisional Patent App. Ser. No. 62/781,967 entitled "Stretching Apparatus and Method for Stretching" filed on 19 Dec. 2018, and the entire specifications of both foregoing applications are incorporated herein by reference.

BACKGROUND OF THE INVENTION

Field of the Invention (Technical Field)

The present invention relates to the field of exercise apparatuses and posture corrective devices, particularly to an apparatus and method for developing greater flexibility, stability (balance and proprioception), strength and neurological reprograming in a user.

Background of the Invention

Stretching is defined as providing a form of physical exercise in which a muscle, ligament, tendon, or joint is deliberately flexed or extended in order to improve muscle elasticity, increase blood flow, or stimulate cartilage health. Currently, persons exercising the foot/leg sometimes use stretching devices including a hand-held strap with a loop opening for the ball of the foot. These devices provide a route to train flexibility through the flexion of the leg. The route is normally provided by the user lying on his/her back, placing the foot in the provided loop, and supporting the full weight of the lower extremity with his/her hand and upper body strength. Known strap devices for exercising a leg are limited to a single-leg use. In the current state of the art stretching devices, multiple loops may be provided on the strap to permit use by persons of different sizes.

The usefulness of the current devices depends in part on the ease with which a user can support the weight of his or her lower extremity. Therefore, the effectiveness of stretching the ambulatory chain with current stretching devices is limited. This limitation can be overcome with the assistance of a personal trainer or other person providing support of the lower extremity. Effective stretching includes activation of the ambulatory chain. With the currently available devices, users can only minimally achieve full range of flexibility through activation of the lower extremities. Particularly, known devices are ineffective in activating the first and second metatarsal, the achillies tendon, and the plantar fascia. Such drawbacks are due to the limited function of the foot loop, in known devices, to provide the significant resistance needed for full extension of the foot joints and tendons listed above. In addition, the resistance provided for an effective stretch is limited by the user's upper body strength, thus varying the degree of efficacy.

Stretching devices known in the art are available in a variety of configurations that include handles or variable strap lengths for ease of support through upper body strength. Currently known devices thus generally limit the user's ability to obtain a sufficient stretch, as the user must still perform the chosen movement to achieve any functionality of the device. This in turn limits the marketability of these devices to people who can perform the movement; but flexibility is encouraged over all age groups including users who may have limitations in strength or injuries that prevent them from operating such a device.

BRIEF SUMMARY OF THE INVENTION

The present invention comprises a hands-free device accessing full dorsal flexion of the complete ambulatory chain. Provided here is a revolutionary stretching apparatus that is beneficial for a broad spectrum of users: from high level athletes to maintain flexibility and dexterity for competition; to the general population who seek better joint health, mobility, or pain management; and finally for the aging and injured population facilitating greater balance and proprioception and stimulating rehabilitation.

The present invention improves upon and overcomes the deficiencies of stretching devices currently used or known in the art. The present invention comprises particular and beneficial elements, specifically comprising a unique system of straps and fasteners for hands-free stretching of the ambulatory chain of muscles, and joints and a uniquely designed anchor to exploit the full flexion of the foot. Extension exercises and stretching are also facilitated. The present invention includes a uniquely designed harness and foot anchor that allows for adjustability for users ranging in size from extra-small to double extra-large. The versatility of the present invention expands the marketability to the general public.

The apparatus comprises a multi-directional, multi-configurable, and adjustable harness comprising a dual strap configuration having a unique multi-joint activating foot anchor. The present invention improves upon currently used and sold devices by incorporating a unique system for hands-free stretching of a single leg, or both legs, through the ambulatory chain of muscles and joints with a uniquely designed anchor to exploit the flexion of the spine, full extension of the leg and pelvis, and the full flexion of the user's foot.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
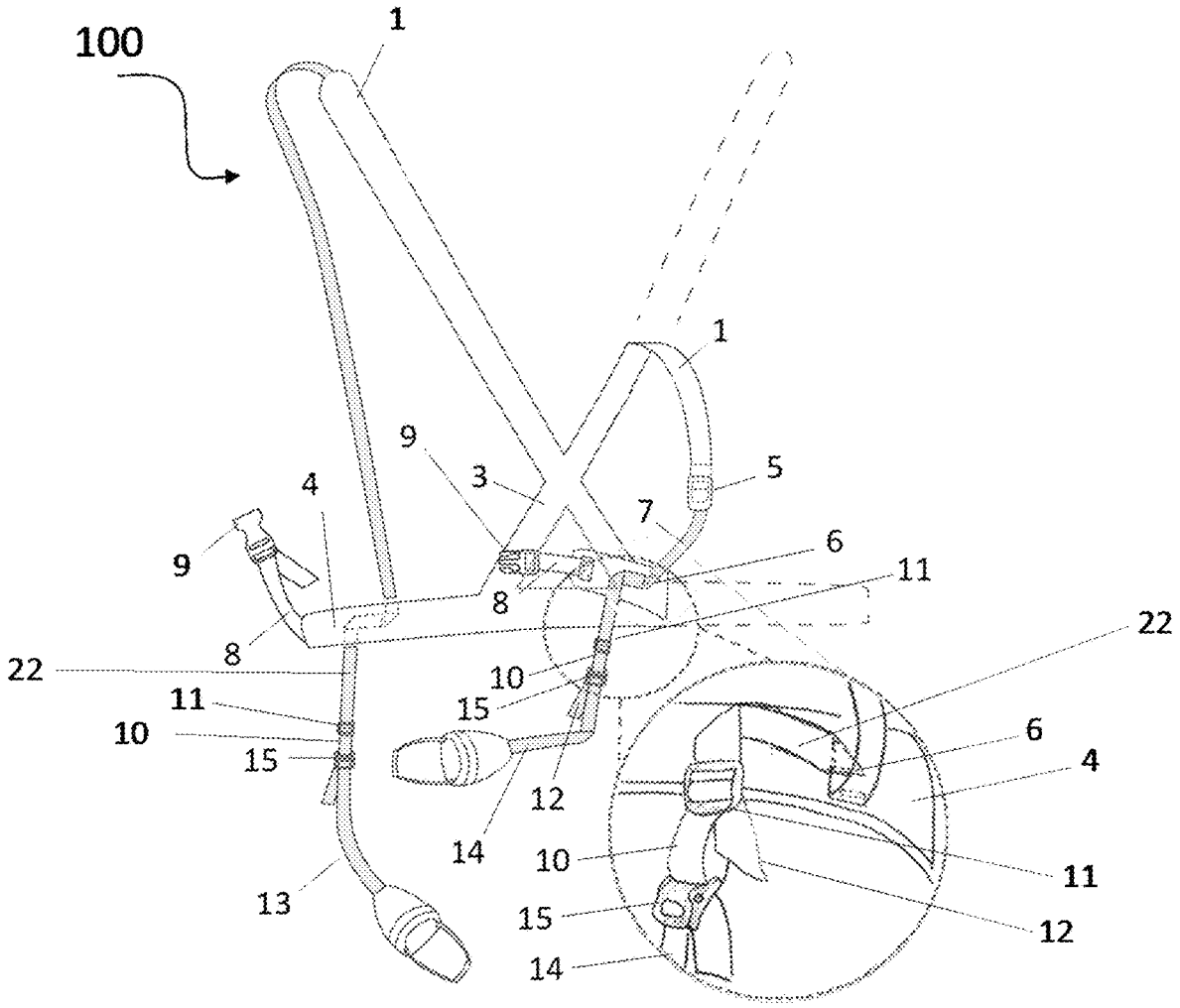
FIG. 1 diagrammatically illustrates a front view of the preferred embodiment of the stretching apparatus of the present invention, with the inset of FIG. 1 detailing an adjustability function of the harness.

The present disclosure is of an easily configurable exercise apparatus that provides a fulcrum harness system, with one or two associated foot anchor(s), for performing a variety of movements, exercises and stretches. The method of using the apparatus and the construction of the apparatus are detailed in the following disclosure. A harness body is devised to be worn about the torso of the user, and has at least one, preferably two, anchor loops secured thereto and adjustably extending therefrom. In the practice of the invention, a user's leg/foot interact with the harness body by means of a foot anchor operatively connected to the harness body by a lower extremity fulcrum strap adjustably engaged with an associated anchor loop.

A stretching apparatus comprising a multi-functional, multi-configurable, hands-free harness system with a unique multi-joint activating foot anchor accordingly is disclosed. The preferred embodiment comprises a harnessing system constructed of stretch woven and spacer mesh, glued, and stitched as a single embodiment to facilitate ease of wear. The harnessing system includes a harness body and padded shoulder straps, each strap adjustable through a ladder lock buckle, which extend to the body of the harness and connect to a posterior diaphragm bolster. The harness system is secured around the user's torso with a webbing waist belt, provided through or on the diaphragm bolster, secured and adjustable using a large side release buckle.

The harnessing system also integrates two anchor loops. The anchor loops may be provided by means of, for example, the shoulder straps extending from the ladder lock buckles, and secured to the diaphragm bolster by, for example, a 45-degree fold with a triangular stitch. Each anchor loop may be fortified by a bar tack. An anchor loop preferably extends through a secondary ladder lock buckle, then looping onto itself to form an adjustable tail. At least one, preferably two, lower extremity fulcrum straps are connected to the anchor loops.

The one or two lower extremity fulcrum straps attach to distal ends of the corresponding anchor loops by means of camming buckles known in the art with spring-loaded locking systems. Thus, the lower extremity fulcrum straps are connected, by the intermediate anchor loops, at the inferior lateral aspects of the diaphragm bolster. The fulcrum straps are made of nylon webbing and terminate at their distal ends with a secure connection to a multi-joint activating foot anchor. The fulcrum strap webbing secures to the foot anchor below the user's first and second metatarsal junction, and extends along a sole terminating at an arch enclosure of the foot anchor.

Each multi-joint activating foot anchor includes a toe box constructed of unidirectional stretch fabric stitched to a padded foot bed and sole. The toe box conforms to the arch of the foot as a result of the stretch fabric and is held in place with a heel loop that is incorporated in the foot anchor in order to engage the back of the foot with the toe box. The heel loop has a strap of webbing that is configured as a continuous loop posterior to the toe box, below the padded foot bed and above the sole. The heel loop webbing is terminated with a vertically oriented ladder lock buckle that is secured to the lateral aspect of the toe box. A separate heel pad is attached to the heel loop through a constructed tunnel made of spacer mesh and high-density foam. The tunnel allows for the heel pad to be selectively moved on and along the heel loop, to permit placement of the heel pad against the user's heel, to accommodate to foot size.

The present invention, including a stretching apparatus, thus preferably comprises a substantially multi-configurational harness and foot anchor that is easily conformable into a plurality of different sizes, and which provides a method for the user to easily perform a variety of varying directional stretches with full range of motion.

FIG. 1 illustrates the front view of the preferred embodiment of the stretching apparatus of the present invention, furnishing a multi-configurable, hands-free, harness system combined with a unique multi-joint activating foot anchor. FIGS. 1 and 2A-D collectively illustrate generally the stretching apparatus described herein, with the hands-free harness system 100 shown in FIG. 1, and a foot anchor 102 shown in FIGS. 2A-D. The harness system 100 with the structure of shoulder straps 1 and harness body 3 with the diaphragm bolster 4, provides support for the functionality and comfort of the overall apparatus-thus allowing for ease during implementation of the stretching apparatus and method for use as a corrective posturing device. A foot anchor 102 as seen in FIGS. 2A-D includes a toe box 16, supported underneath by a padded foot bed 20 and sole 21, and a heel loop 18 with heel pad 19; the toe box and/or the heel loop jointly or individually provide a means for engaging a user's lower extremity with the apparatus. "Lower extremity" means a user's leg or portion thereof, including the knee and/or foot.

Figure 3A:
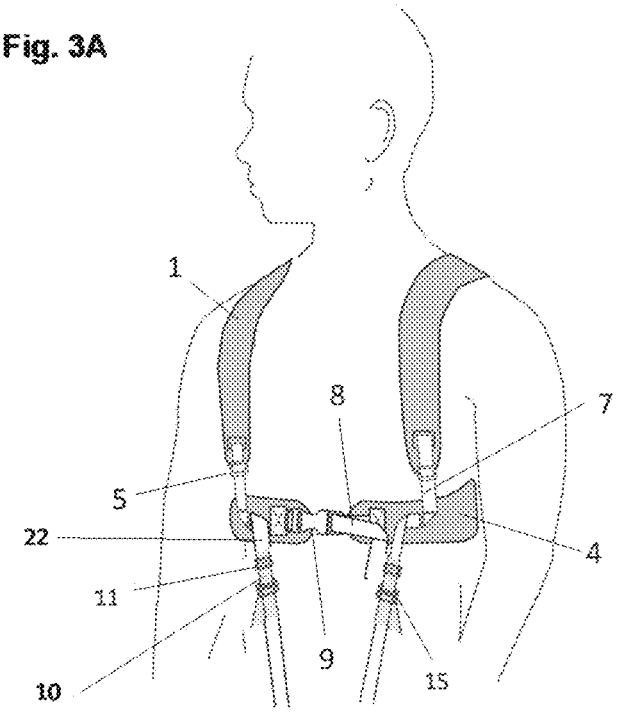
FIGS. 3A and 3B are anterior (front) and posterior (back) views, respectively, of one embodiment of the stretching apparatus as worn by a user.
Figure 3B:
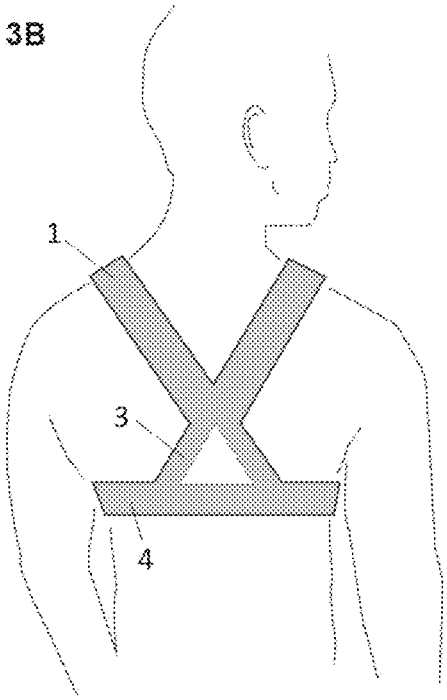

Attention is invited to FIGS. 3A and 3B, providing contextual overviews of the harness system as disposed for use on the torso of a user. The harness body 3 is worn in a somewhat vest-like manner upon the upper torso. The harness body 3 includes a diaphragm bolster 4, which is releasably disposed circumferentially around the torso. Free ends of the bolster 4 are brought into proximity, and connected via a waist belt 8, fastenable with a two-part side-release buckle 9, known in the art. One component of the side-release buckle 9 is slidably adjustable on an associated portion of the waist belt 8, permitting the effective length of the waist belt to be regulated so to adjustably adapt the harness system 100 to the circumferential size of the user's torso. A pair of shoulder straps 1 extend front-to-back over the user's shoulders in a generally conventional manner. At the rear of the apparatus, the shoulder straps 1 may be, and preferably are, integrated with the harness body 3, as seen in FIG. 3B. At the front sides of the apparatus, the shoulder straps 1 are releasably connectable to the bolster 4 by means of conventional ladder-lock type buckles 5 (FIGS. 1 and 3A). Ladder-lock buckles 5 are known in the art for providing releasable connectivity between the ends of straps portions, as well as for adjusting the effective length of the connected straps. Such buckles 5 are provided at the free ends of configurable loop straps (see element 7 in FIGS. 1 and 3A), whose base ends are attached to the bolster, also as seen in FIG. 1. After their respective releasable connections, a manipulation of the ladder-lock buckles 5 relative to the configurable loop straps 7 permits the effective lengths of the shoulder straps 1 to be adjustable to comfortably to position the harness system 100 on the user's body.

Combined reference is made to FIGS. 1 and 3A. The shoulder straps 1 are fully and independently adjustable by using the ladder-lock buckles 5 (two seen in FIG. 3A). Each ladder lock buckle 5 is attached to the diaphragm bolster 4 by a webbing strap (see element 7 in FIG. 1), preferably with a 45-degree fold sewn in the webbing by a triangular stitch 6. Each shoulder strap 1, buckle 5, and corresponding webbing strap thus creates a configurable shoulder loop of adjustable loop size. The harness system 100 is secured around the user's torso by the webbing waist belt 8 through or on the diaphragm bolster 4. As mentioned, the free ends of the waist belt 8 are held and, the effective length of the belt 8 is adjustable, by means of a large side release buckle 9.

FIGS. 3A and 3B generally illustrate the anterior and posterior views, respectively, of one embodiment of the stretching apparatus, particularly the harnessing system 100. The apparatus size configuration is fully adjustable using the ladder-lock buckles 5 provided at the shoulder straps 1. The ladder-lock buckles 5 permit the diaphragm bolster 4 to be controllably raised or lowered in relation to the user's body, as suggested in FIG. 3A and described previously. The location during use of the diaphragm bolster 4 of the multi-configurational harness body 3 is deliberately selected to release the arcuate ligament and the attachment of the diaphragm in the lower thoracic spine. The flexibility of this region can have many benefits including increased breathing capacity, more efficient blood flow through the diaphragm and kidneys, increased flexibility of the psoas, and overall mobility of the lumbar and thoracic spine junction. FIG. 3A also illustrates the configurable loop 7 that is effectively a continuation of shoulder straps 1 and which ensures a secure and supportive fit.

As best seen in FIG. 1, attached to the right and left exterior sides of the diaphragm bolster 4 of a preferred embodiment of harness system 100 are two anchor straps 22, each of which defines therein a respective anchor loop 10; an anchor loop is defined in or at a distal end of each anchor strap 22. The proximate end of each anchor strap 22 is attached directly to the harness body at an immobile, fixed, connection point 6 on the bolster 4. The inset view of FIG. 1 illustrates the provision of a left-side anchor strap 22, its immovable connection 6 to the bolster 4 at the triangular stitch, and its engagement (by means of a camming buckle 15) with a left-side lower extremity fulcrum strap 14. It is understood that the apparatus has at least one anchor loop and fulcrum strap assembly, and preferably two such assemblies as suggested in FIG. 1. Accordingly, description of the left-side anchor strap 22 and anchor loop 10 and fulcrum strap assembly detailed in the inset view of FIG. 1 serves to describe a right-side such assembly as well.

It is noted in FIGS. 1, 3A, and 4-6 that the proximate end of each anchor strap 22 is immovably attached directly to the bolster 4 of the harness system 100 by any suitable means, preferably by a reliably sewn point of connection 6. The location of the anchor strap's connection point 6 on the bolster 4 accordingly is immovable and fixed relative to the harness body 100. While the connection point 6 does not move or shift in relation to the bolster 4, the anchor strap 22 remains flaccid or "loose" (unless tensioned by a user), so that the position in space of the anchor loop 10, itself, is swingably movable freely relative to the harness body 100. Each of the lower extremity fulcrum straps 13 and 14 is linked to and extends from an associated anchor loop 10 in a manner explained further herein below.

Each anchor strap 22 is fortified by a bar tack, and extends through a secondary ladder-lock buckle 11, and loops onto itself thereby to define an adjustable anchor loop 10 having an adjustable tail 12 as seen in FIG. 1. The ladder-lock buckle 11 permits (according to conventional such buckles) an adjustment to the effective length (measured from the bolster 4) of the anchor strap 22, and thus the size of the defined anchor loop 10. The doubling-back of the anchor strap 22 (FIG. 1) through the ladder-lock buckle 11 thus serves to create and define the anchor loop 10 to which the camming buckle 15 of the fulcrum strap 13 or 14 is slidably connected. The effective distance of the closed loop of the anchor loop 10 from the bolster (as measured from the fixed connection point 6 on the bolster 4) is adjustable, via manipulation of the buckle 11, so to accommodate different users of varying torso girth. Each of the two anchor loops 10 may be used for engagement of the dual lower extremity fulcrum straps (to be described further herein) in relation to the harness system 100.

Thus each anchor loop 10 is a closed but adjustable loop defined within or by its corresponding anchor strap 22; the anchor loop thus is in the strap 22. Each anchor strap 22 is doubled back against itself and passed through the secondary ladder lock buckle 11 to create the associated anchor loop 10. The effective distance, from the bolster 4, of the closed portion (folded through the buckle 11) of the anchor loop 10 is adjustable by manipulating the buckle 11. In principle, therefore, the anchor loop 10 may be pulled (by the tail 12) through the rungs of the secondary ladder lock buckle 11 so as to bring the buckle 11 immediately adjacent to the stitched connection point 6—in other words, the effective distance of the closed portion of the anchor loop 10 from the bolster body 4 goes to zero. In such instance, the anchor strap 22 is fully subsumed into the anchor loop.

The lower extremity fulcrum straps 13 and 14 extend from a respectively associated anchor loop 10. (See also FIGS. 3A and 4.) Referring particularly to the inset view of FIG. 1, it is seen that the anchor loop 10 is passed through a slot in a commercially available spring-biased camming buckle 15, so that the buckle 15 is movably situated on the closed anchor loop 10. An associated lower extremity fulcrum strap 14 is slidably threaded through the camming buckle 15 thereby to link the fulcrum strap to the anchor loop 10; linkage is provided by the disposition of both the fulcrum strap 14 and the anchor loop 10 upon their shared camming buckle 15. During the practice of the invention, the working length of the fulcrum strap 14 (or 13) can be adjusted by controlled engagement/release of the camming buckle 15. To accomplish a stretch method according to the invention, a lower extremity fulcrum strap 14 (and/or 13) is controllably tensioned (and the tension regulated or released). The tension is applied by the extension/flexion of a lower extremity, and regulated by the operation of the camming buckle 15 which is biased to be in clamping engagement with a strap 13 or 14, but selectively releasable by the user's pulling on the free end of the strap. The overall apparatus is controlled by fully configurable camming buckles 15 with spring-loaded locking systems, providing the control center for performing the stretching exercises according to the invention.

Figure 2A:
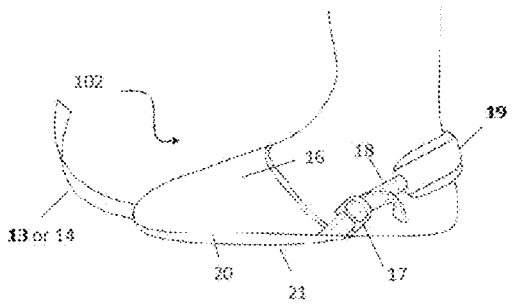
FIG. 2A is a left side view of a fully adjustable foot anchor according to the invention.
Figure 2B:
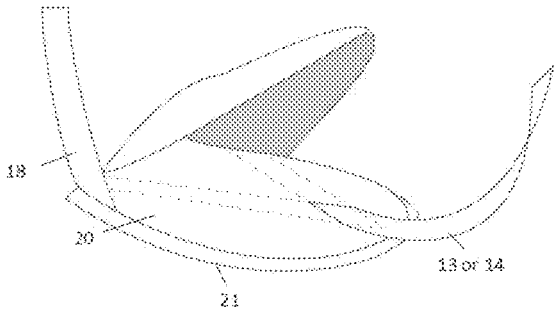
FIG. 2B is a front perspective view of the fully adjustable foot anchor according to the invention, with an upper cover portion partially removed and lifted to reveal the attachment of a lower extremity fulcrum strap upon a foot bed.
Figure 2C:
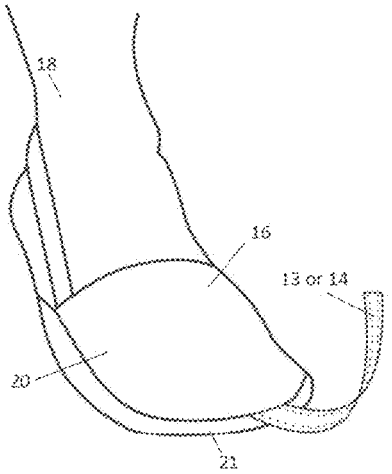
FIG. 2C is a front perspective view of the foot anchor seen in FIG. 2B, with a user's foot, and the upper cover portion, in place for the practice of the invention.
Figure 2D:
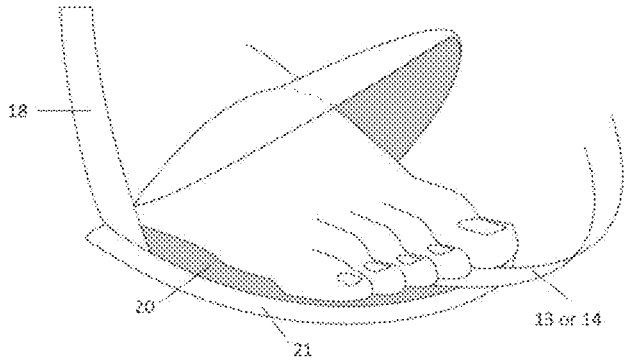
FIG. 2D is a front perspective view of the foot anchor seen in FIG. 2C, with a user's foot in place for the practice of the invention, and with the upper cover portion partially removed and lifted to reveal the relative positions of the user's foot and the lower extremity fulcrum strap upon the foot bed.

Each of the lower extremity fulcrum straps 13, 14, is complemented with a corresponding connected foot anchor 102, as best illustrated in FIGS. 2A-D, and seen also in FIG. 1. As indicated in the figures, a foot anchor 102 is reliably secured to the distal end of each lower extremity fulcrum strap 13, 14. Such a connection may be made in any suitably secure manner, such as sewing a portion of the end of the strap 13, 14, to a cushioned foot bed 20. FIG. 2B shows the toe box's fabric upper cover illustratively "peeled back" (per the small directional arrow in the figure) to reveal the configuration of the lower extremity fulcrum strap 14 (or 13), including its being wrapped around the rear of the foot anchor 102. The fulcrum strap 13 or 14 is reliably attached to the front of the foot pad 20 as by a secured stitched connection, as seen in FIG. 2B. The point connection of the fulcrum strap 13 or 14 to the foot pad 20 preferably is located just below the user's toes at a point laterally between a user's first and second metatarsal bones as best indicated in FIG. 2D. FIG. 2C shows that that foot anchor 102 preferably includes a rubber sole 21 atop which is mounted the complementary cushioned foot pad 20. As also seen in FIG. 2C, a comfortable fabric upper cover, sewn at its periphery to the footpad 20 and/or sole 21, defines the top portion of the toe box 16.

Each integrated foot anchor 102 accordingly includes a toe box 16 supporting the user's metatarsi, as well as the sole 21 above which is securely provided the padded foot bed 20. The toe box 16 is held on the foot by a heel loop 18 equipped with a heel pad 19, allowing for fully adjustable sizing, as best indicated in FIG. 2A. As suggested by combined reference to FIGS. 2A and 2B, the heel loop 18 may be integral with, and defined as an extension of, the corresponding lower extremity fulcrum strap 14 (or 13). The heel loop 18 thus has ends reliably secured (again, as by sewn stitches or the like) to the foot bed 20 and/or sole 21. Ends of the loop 18 are sewn at a juncture beneath the user's toes between the hallux (big toe) and the index toe (second tow) at the front of the toe box 16, as suggested by FIG. 2A-B, which also defines the point of departure of a lower extremity fulcrum strap 14 (or 13), as seen in FIGS. 2A-D. A free end of the heel loop 18 is wrapped around the user's heel as seen in FIGS. 2A and 2B. A heel loop buckle, seen in FIG. 2A, is anchored to a second side of the sole 21. The free end of the heel loop 18 is passed through the heel loop buckle 17, permitting the user to adjust the tension in the heel loop. The heel pad 19 on the loop 18 improves user comfort.

Figure 2E:
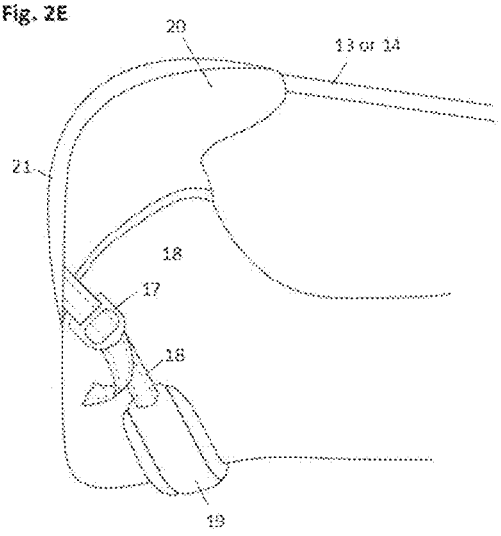
FIG. 2E is a perspective view of the foot anchor in use upon a patient's left foot to promote flexion of the foot according to the present invention.
Figure 2F:
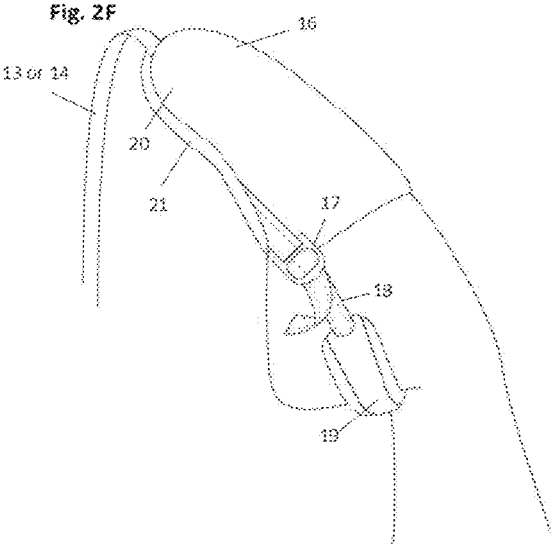
FIG. 2F is a perspective view of the foot anchor in use upon a patient's foot to promote extension of the foot.

An aspect of the foot anchor 102 is the toe box 16 with its selected placement of a fulcrum strap 13 or 14 on (or alternatively under) the padded foot bed 20 and above the sole 21. The foot anchor 102 is configured such that the location of secure connection between the respective fulcrum strap 13, 14, and the foot anchor preferably is at a juncture below the user's toes, yet laterally between a user's first and second metatarsal bones as indicated in FIG. 2D; such a connective point of security of a fulcrum strap under the user's foot but on the foot bed advantageously promotes flexion and extension, as indicated in FIGS. 2E and 2F respectively, of the hallux and second toes principally, and secondarily the other tarsals. The deliberate location of the fulcrum strap's point of connection at a juncture below the toes but between the first and second metatarsals promotes activation (during the practice of the invention) of the first and second metatarsals, the Achilles tendon, and the plantar fascia. This focused and controlled and deliberate flexion and extension are specific advantages of the apparatus and method. The foot anchor 102 is fully adjustable for different sized feet by releasing the heel loop buckle 17, and by sliding the heel loop 18 to the appropriate size.

The padded foot bed 20 of the foot anchor relieves overall tension in the foot during stretching. The full flexion of this region of the foot, particularly but not limited to plantar flexion, is important for increased proprioception and balance for added mobility and also prevention and treatment of bunion conditions.

The presence of the heel loop 18 encourages complete Achilles' tendon flexibility, while providing plantar fascia mobility and increased blood flow through the plantar portion of the foot during practice of the invention. In addition, such anchoring at the back of the heel provides increased flexibility of the posterior knee joint, specifically activating the condyle attachments of the hamstring and the calf, facilitating increased blood flow and lymphatic drainage and mobility through the lower extremity.

Figure 4:
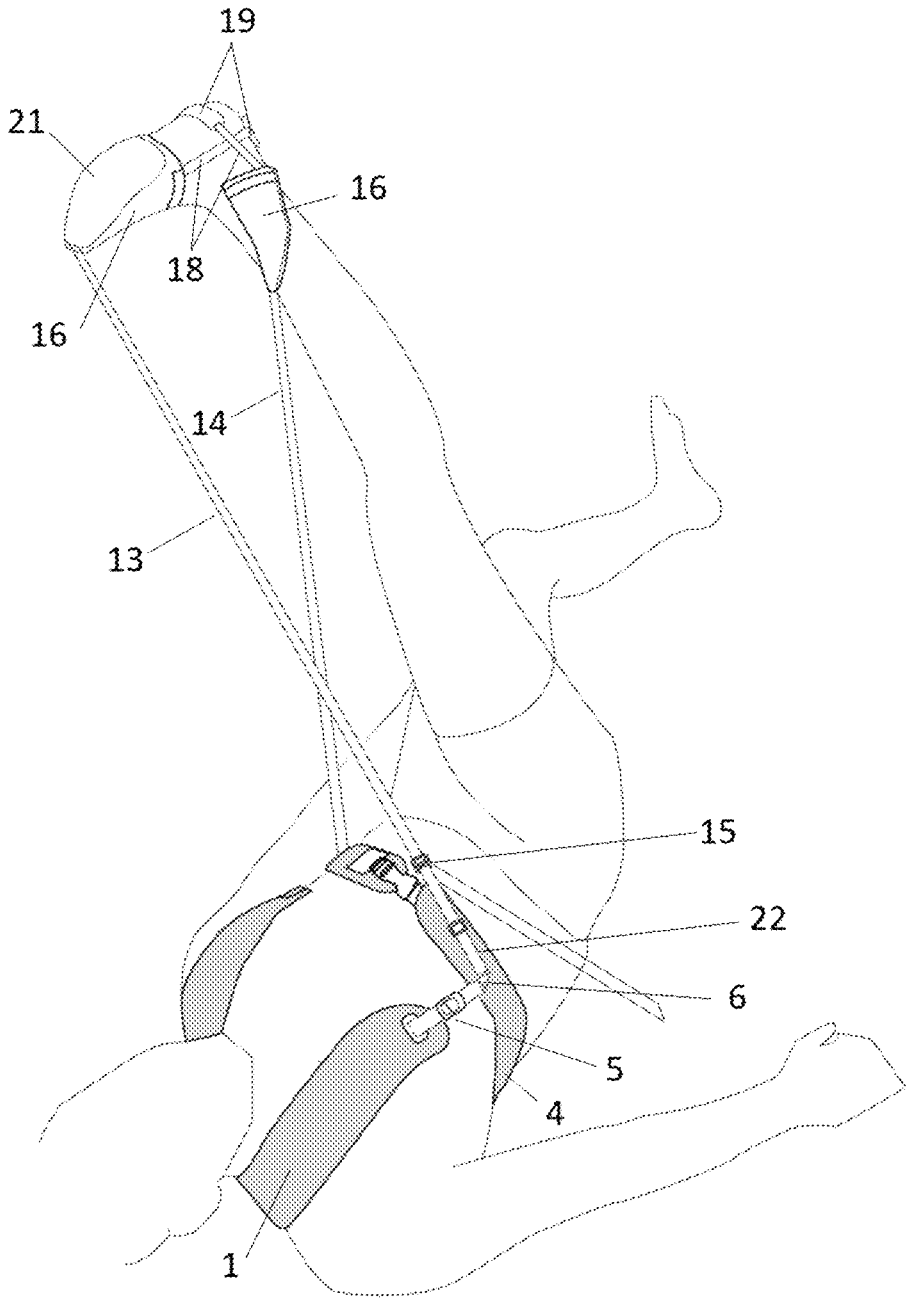
FIG. 4 is a perspective view of a person using both extremity fulcrum straps for a single leg extension in front and across the body, according to the present invention.

FIG. 4 is an illustration of one possible, exemplary, method of use of the present invention implementing both extremity fulcrum straps 13 and 14 for a single leg extension across the body. In this example, the user secures the harness around his or her torso, and adjusts it to a comfortable fit by means of the waist belt 8 and shoulder straps 1 and associated buckles. The user then lies on his or her back, with the support of the diaphragm bolster 4 facilitating a safe spine placement while stretching. Placing his or her foot in the foot anchor 102 adjacent to the "loose" leg (in the example of FIG. 4, the loose left leg is adjacent to the right-side foot anchor and is not incorporated in the device), he or she extends the right-side foot anchor leg, while adjusting (via the spring-biased camming buckle 15) the fulcrum strap 13 for length. The user preferably simultaneously engages the second fulcrum strap 14 with the heel of the extended foot, using the second strap's 14 unused heel loop 18 beneath the heel, and supported by the heel pad 19 around the heel contained in the used foot anchor. Deliberately and controllably tightening either or both fulcrum straps 13, 14, as engaged through the respective anchor loop 10, draws the leg cross-body for a comprehensive stretch. This stretch is extended through the full range of motion by controlled adjustment of the dual camming buckles 15 of the system. By alternatively locking and releasing the respective camming buckles 15 on the two fulcrum straps 13, 14, the user can regulate the effective working length of the fulcrum straps (and associated anchor loops) to adjust not only the extent of cross-body motion of the extended leg, but the degree of plantar flexion in the foot and the stretching of the complete ambulatory chain of muscles and joints of the extended leg. It is readily understood that the "right leg" exercise of FIG. 4 can be performed on the left leg by simply reversing the operative configuration of the apparatus. It also is to be recognized that the exercise can be performed "hands free," with the user having to use their hands only as needed for timely manipulation of a camming buckle 15.

The swinging or pivotal movement of the respective fulcrum straps 13, 14 is facilitated by the flexible character of the fulcrum straps and the two anchor straps 22; all four such straps are maintained mostly in tension during the practice of the method, and the swinging motion is limited by the connection points 6 serving as pivot points.

In the case of injury, the apparatus of the present invention provides the user a method to target or avoid uncomfortable positions, facilitating recovery while still enabling the user to achieve the benefits of stretching without causing pain. Typically, this range of motion is achieved through advanced yoga poses and is not feasible through stretching devices presently known in the art. The invention described here thus provides a method and apparatus for a broader range of users to achieve the benefits of such a movement in a relaxed position. Due to the apparatus' versatility of configuration, the above-mentioned usage may be extended to both legs through independent configurations and more complex exercises.

Figure 5:
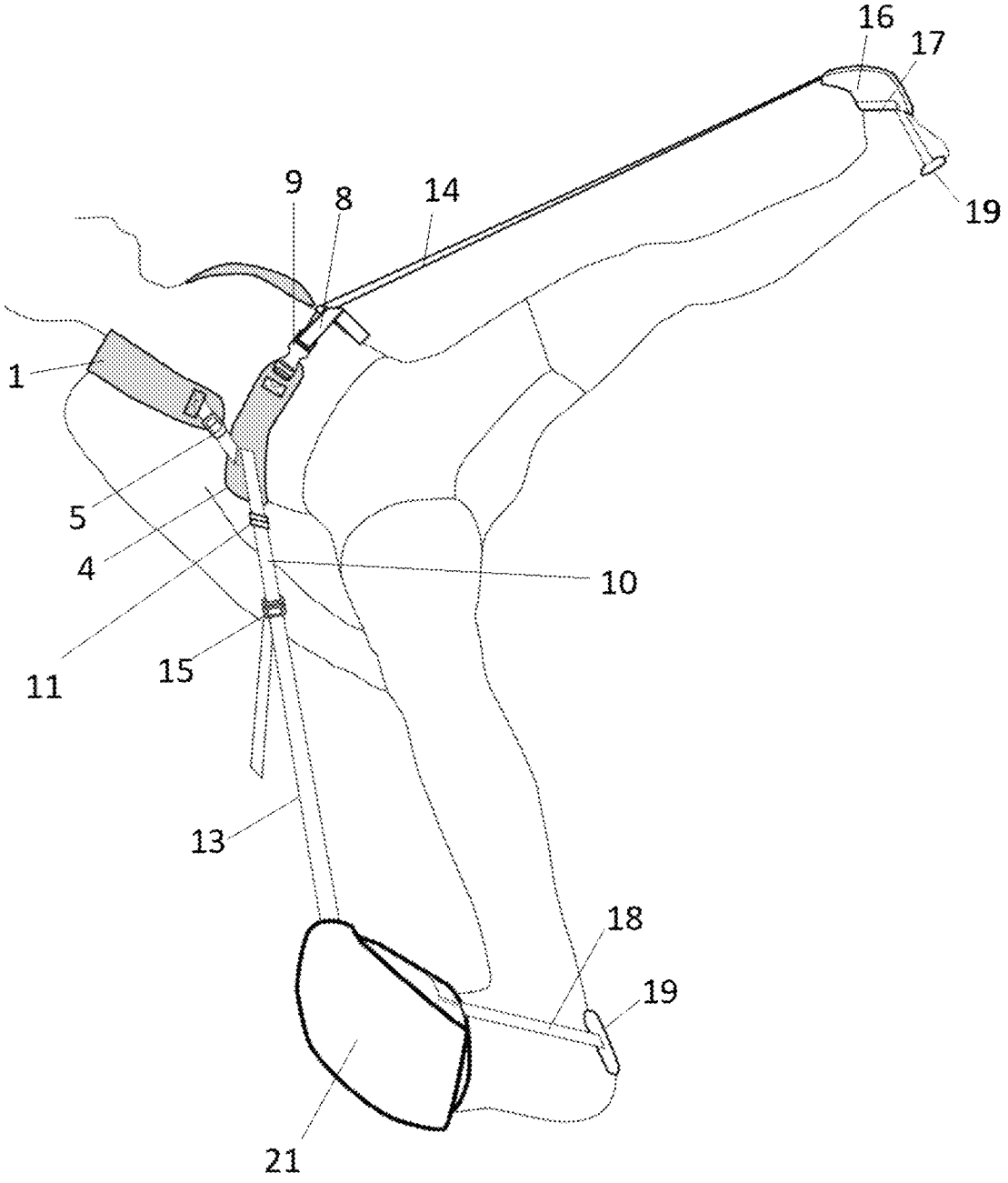
FIG. 5 is a perspective view of a person using both extremity fulcrum straps for a dual leg extension in a split configuration, according to the present invention.

FIG. 5, for example, is an illustration of another method according to the present invention, using both extremity fulcrum straps 13, 14 for a dual leg extension in a split configuration. FIG. 5 illustrates a split configuration that relies on the novel harness apparatus of the present invention for support in this relatively difficult position. The user lies on his/her back, and places a foot in each of the two respective foot anchors 102 on the distal ends of the corresponding fulcrum straps 13, 14. This dual leg configuration and method is believed to be unique for the invention disclosed herein, because a variety of exercises and movements are achieved through the full range of motion with full support, and yet relatively little effort on behalf of the user. The effective length of each lower extremity fulcrum strap 13, 14 can be adjusted independently depending on, for instance, the desired leg configuration based on injuries, the flexibility or mobility of the user, the skill level of the user, age of the user, etc., by using the controllably engageable/releasable camming buckles 15 with spring-biased locking.

FIG. 5 also illustrates the advantage of adjusting the working length of the extremity fulcrum straps 13, 14, as connected to the foot anchors 102 between the user's first and second metatarsals, to optimize plantar flexion of the foot. (See also FIG. 2E.) Further, as tension in the fulcrum straps 13, 14 is controllably increased/decreased by changing the effective length of the fulcrum straps, the user is able to customize the stretching of the full collection of muscles, tendons, and joints of each leg. Again, and as depicted in FIG. 5, the practice of the invention to accomplish beneficial stretching exercise can be accomplished in an essentially "hands free" mode.

The previously described exercises have been performed in a relaxed state on the ground. More advanced movements are implemented in a standing position.

Figure 6:
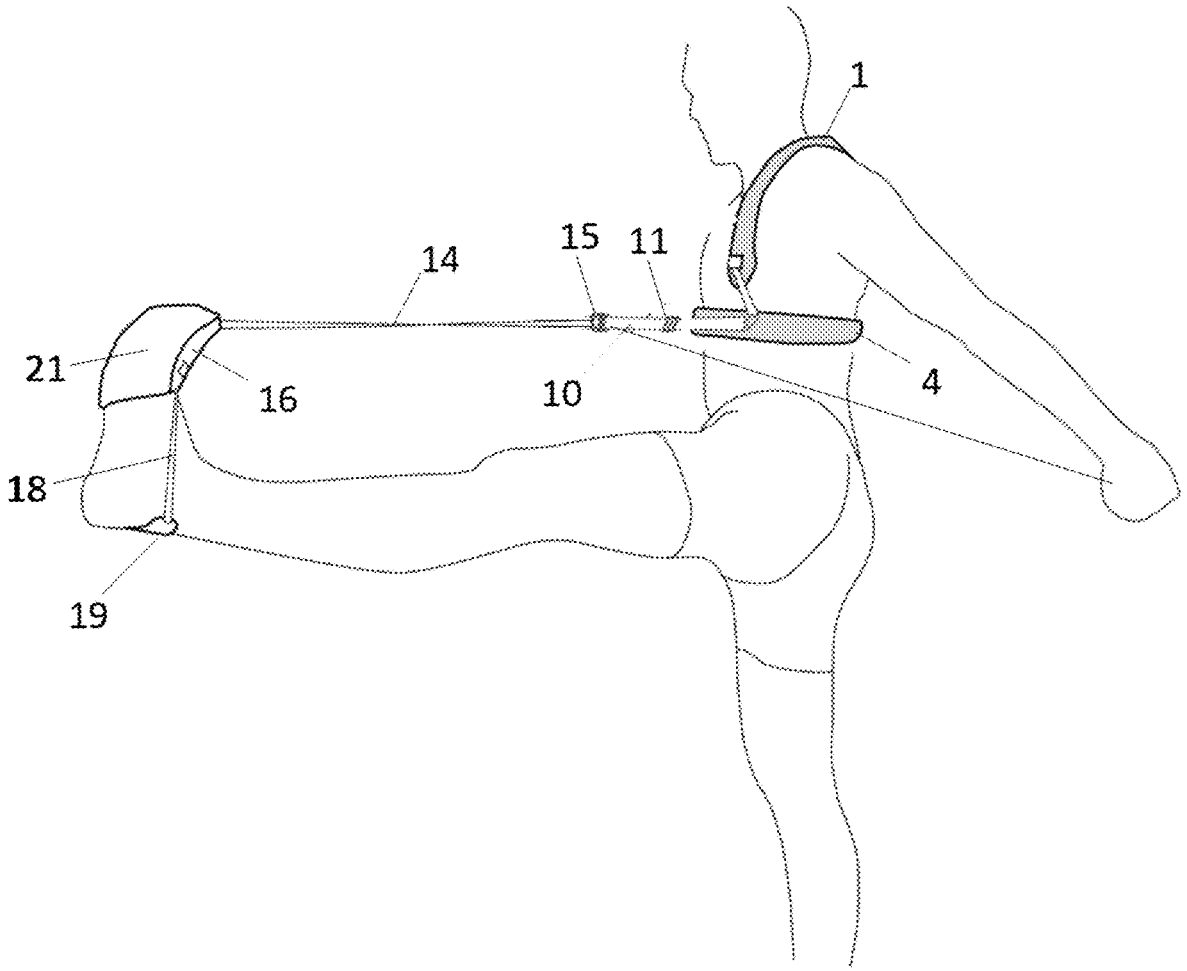
FIG. 6 is a side view of a person using an extremity fulcrum strap for a single leg extension in front kick stance, according to the present invention.

FIG. 6 is an illustration of a method of the present invention using the left extremity fulcrum strap 14 for a single-leg extension in a front kick stance. The left leg, as supported by the fulcrum strap 14 connected to the anchor loop 10, is extended in front of the body. The controllably releasable-engageable camming buckle 15 provides for incremental adjustment of the height of the leg, thus progressing the difficulty and resistance of the movement with minimal adjustments by the user. The stretching device is thereby extended into dynamic functionality.

This usage demonstrates a unique benefit of the stretching apparatus, leading to the development of flexibility with neurological control. This type of conditioning is important for elite level athletes, mixed martial artists, and dancers in order to increase performance while preventing injury. Such dynamic movement not only benefits the extended leg, but it develops a high level of proprioception and balance in the supporting leg.

The feature of a hands free apparatus with dynamic functionality facilitates complete control of each movement described above in a repetitive fashion. Replication of each movement is important for progression in athletic performance. This is unique to the current invention, due to the fact that the support of the lower extremities does not depend on the user's strength and dexterity, including upper-body strength.

In the case of posture correction, the apparatus of the present invention provides the user a method to sit in a relaxed state while facilitating increased spinal extension to rehabilitate poor posture and to relieve users of back and hip pain.

Figure 7A:
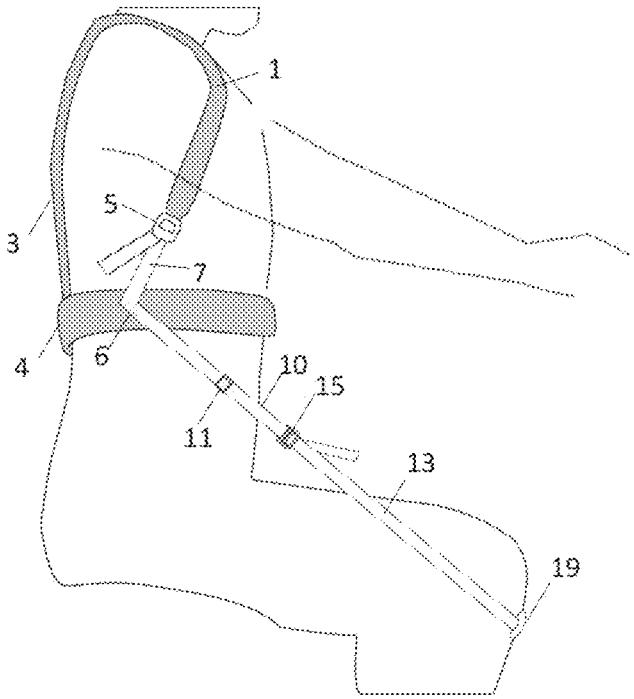
FIG. 7A is a right side view of a person using the extremity fulcrum straps of a preferred embodiment, with associated heel loops, as a posture correction apparatus.
Figure 7B:
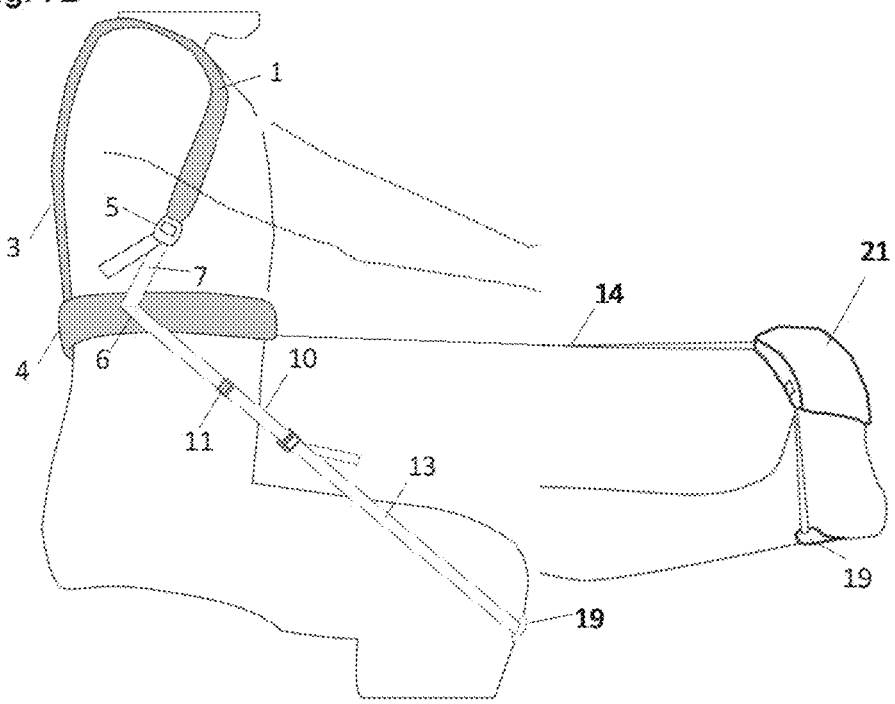
FIG. 7B is a right side view of a person using the apparatus simultaneously as a corrective posture device and as a stretching apparatus, by positioning the heel loop of one fulcrum strap around one knee joint, and utilizing a second fulcrum strap and associated foot anchor to extend the opposing leg into a flexed position.

For example, FIG. 7A is an illustration of an example method of use to correct posture during sitting. The respective heel pads 19 are positioned around the knees, and the fulcrum straps 13, 14 are adjusted using the camming buckles 15 to provide tension for incremental extension of the spine via the support provided by the diaphragm bolster 4. The present invention allows for corrective posture measures in all seated positions, and is not limited to the current state of the art "chair position." Correct posturing of the lumbar spine allows for natural curvature of the thoracic spine, thereby relieving back, neck, and hip pain. The unique positioning of heel pads 19 in FIG. 7A allows for direct pressure to be applied to the inferior patellar tendon, causing more blood flow and hydrating scar tissue-therefore eliminating knee discomfort and increasing mobility of the knee joint. The present apparatus thus is a versatile apparatus that allows for a single embodiment to be used as a stretching device and as a posture correction device. Further, FIG. 7B is an illustration of an example where the apparatus can be used simultaneously as a corrective posture device and as a stretching apparatus, by positioning the heel pad 19 of a first fulcrum strap 13 around one knee joint, and utilizing the second fulcrum strap 14 and associated foot anchor 102 to extend the opposing leg into a flexed position.

Existing devices known in the art typically comprise one single strap with modular sections, such as ladder loops for different hand positions or handles, which are typically monolithic pieces of webbing or cotton sashes. All of the current devices thus require the user disadvantageously to involve her or his hand, with the support of his or her arm strength, to leverage the lower extremity.

The apparatus of the present invention, including as it does the torso harness system 100, as it permits a hands-free usage, yet by operation of the camming control buckle 15 allows full range adjustability. Moreover, the apparatus and method advantageously include the toe box 16, which allows for beneficial targeted flexion and extension of the metatarsi. These features provide the user with the ability to establish replication of resistance, which is essential for injured or rehabilitating patients to recover faster and avoid re-injuring themselves. Replicable resistance is essential for high level athletes to track performance and progress.

Although the invention has been described in detail with particular reference to these preferred embodiments, other embodiments may achieve the same results. In the previous description, specific details are set forth, such as specific materials, structures, processes, etc., in order to provide a thorough understanding of the present invention. However, as one having ordinary skill in the art would recognize, the present invention can be practiced without resorting to all the details specifically set forth. In other instances, well-known principles of mechanics, physiology, and physics have not been described in detail, in order not to unnecessarily obscure the present invention.

Only some embodiments of the invention and a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover with the appended claims all such modifications and equivalents.

I claim:

1. A method for stretching exercise comprising:

disposing a harness body on a torso of a user;

providing a diaphragm bolster connected to the harness body;

releasably securing, with an adjustable waist belt, the diaphragm bolster around the torso;

stitching at least one anchor strap directly to the diaphragm bolster at an immobile fixed connection point;

defining an anchor loop on a distal end of each of the at least one anchor strap;

connecting a lower extremity fulcrum strap to each anchor loop by:

situating a camming buckle on the anchor loop; and threading the lower extremity fulcrum strap through the camming buckle;

securing to the lower extremity fulcrum strap a foot anchor comprising a toe box enclosure and a foot bed;

looping the lower extremity fulcrum strap to define a heel loop, and sewing the lower extremity fulcrum strap to the foot bed at a juncture below and between the user's first and second metatarsals when a user's foot is configured to be engaged with the foot anchor;

engaging at least one lower extremity with each lower extremity fulcrum strap; and tensioning the lower extremity fulcrum strap.

2. The method according to claim 1 wherein the step of disposing the harness body further comprises:

providing adjustable shoulder straps connected to the harness body;

placing the adjustable shoulder straps over shoulders of the user;

releasably connecting the adjustable shoulder straps to the diaphragm bolster; and positioning the diaphragm bolster by adjusting effective lengths of the adjustable shoulder straps.

3. The method according to claim 2 wherein the step of connecting the lower extremity fulcrum strap to each anchor loop comprises adjusting by means of the camming buckle an effective length of the anchor loop.

4. The method of claim 1 wherein the step of stitching the at least one anchor strap directly to the diaphragm bolster comprises stitching a first anchor strap directly to the diaphragm bolster, and wherein the step of connecting the lower extremity fulcrum strap to each anchor loop comprises connecting a first lower extremity fulcrum strap to a first anchor loop of the first anchor strap, and further comprising:

providing a first toe box enclosure on a first foot anchor of the first lower extremity fulcrum strap; and providing a first heel loop on the first foot anchor;

wherein the step of engaging the at least one lower extremity with each lower extremity fulcrum strap comprises:

engaging a first leg of the user with the first lower extremity fulcrum strap;

engaging, with the first toe box enclosure, toes of the first leg;

engaging, with the first heel loop, a heel of the first leg; and extending the first leg thereby to tension the first anchor strap and the first lower extremity fulcrum strap directly between the respective immobile fixed connection point and the juncture of the first foot anchor.

5. The method of claim 4 further comprising adjusting an effective length of the first lower extremity fulcrum strap while extending the first leg, by controllably actuating or releasing the camming buckle.

6. The method of claim 5 further comprising stretching the first extended leg by cross-body motion.

7. The method of claim 6 further comprising:

adjusting an extent of the cross-body motion of the first extended leg;

adjusting a degree of plantar flexion in a foot of the first extended leg; and adjusting a stretching of an ambulatory chain of muscles and joints of the first extended leg.

8. The method of claim 4 wherein the step of stitching the at least one anchor strap directly to the diaphragm bolster further comprises stitching a second anchor strap directly to the diaphragm bolster, and wherein the step of connecting the lower extremity fulcrum strap to each anchor loop further comprises connecting a second lower extremity fulcrum strap to a second anchor loop of the second anchor strap, and further comprising:

providing a second toe box enclosure on a second foot anchor of the second lower extremity fulcrum strap; and providing a second heel loop on the second foot anchor;

wherein the step of engaging the at least one lower extremity with each lower extremity fulcrum strap comprises:

engaging a second leg of the user with the second lower extremity fulcrum strap;

engaging, with the second toe box enclosure, toes of the second leg;

engaging, with the second heel loop, a heel of the second leg; and extending the second leg thereby to tension the second anchor strap and the second lower extremity fulcrum strap directly between the respective immobile fixed connection point and the juncture of the second foot anchor.

9. The method of claim 8 further comprising adjusting an effective length of at least one of the first and second lower extremity fulcrum straps while extending the first leg or the second leg, by controllably actuating or releasing either of the camming buckles.

10. The method of claim 9 further comprising extending the first and second legs in a split configuration in which a distance between ankles of the user exceeds a width of a pelvis of the user.

11. The method of claim 10 further comprising:

adjusting a degree of plantar flexion in a first foot of the user;

adjusting a degree of plantar flexion in a second foot of the user;

adjusting a stretching of an ambulatory chain of muscles and joints of the extended first leg; and adjusting a stretching of an ambulatory chain of muscles and joints of the extended second leg.

12. The method of claim 1 wherein the step of stitching the at least one anchor strap directly to the diaphragm bolster further comprises stitching first and second anchor straps at two immobile fixed connection points, respectively, on the diaphragm bolster, and wherein the step of connecting the lower extremity fulcrum strap to each anchor loop comprises connecting first and second lower extremity fulcrum straps to the first and second anchor loops, respectively, and further comprising:

providing a first heel loop connected to the first lower extremity fulcrum strap; and providing a second heel loop connected to the second lower extremity fulcrum strap;

wherein the step of engaging the at least one lower extremity with each lower extremity fulcrum strap comprises:

engaging, with the first heel loop, a knee of a first leg of the user; and engaging, with the second heel loop, a knee of a second leg of the user.

13. The method of claim 12 further comprising adjusting an effective length of at least one of the first and second lower extremity fulcrum straps by controllably actuating or releasing either of the camming buckles.

14. The method of claim 13 further comprising correcting posture during sitting, wherein the step of controllably actuating or releasing either of the camming buckles comprises providing a tension for incremental extension of a spine of the user via a support provided by the diaphragm bolster.

* * * * *